US011517791B2

(12) United States Patent
Kuo

(10) Patent No.: US 11,517,791 B2
(45) Date of Patent: Dec. 6, 2022

(54) TORQUE DETECTION DEVICE OF FITNESS EQUIPMENT

(71) Applicant: Sports Art Industrial Co., Ltd., Tainan (TW)

(72) Inventor: Hai-Pin Kuo, Tainan (TW)

(73) Assignee: Sports Art Industrial Co., Ltd., Tainan (TW)

( * ) Notice: Subject to any disclaimer, the term of this patent is extended or adjusted under 35 U.S.C. 154(b) by 166 days.

(21) Appl. No.: 17/061,519

(22) Filed: Oct. 1, 2020

(65) Prior Publication Data

US 2022/0105388 A1 Apr. 7, 2022

(51) Int. Cl.

| | |
|---|---|
| ***A63B 24/00*** | (2006.01) |
| ***A63B 21/22*** | (2006.01) |
| ***A63B 21/00*** | (2006.01) |

(52) U.S. Cl.

CPC ..... *A63B 24/0062* (2013.01); *A63B 21/151* (2013.01); *A63B 21/225* (2013.01); *A63B 2220/51* (2013.01); *A63B 2220/54* (2013.01); *A63B 2220/58* (2013.01); *A63B 2225/09* (2013.01)

(58) Field of Classification Search

CPC .. A63B 21/00192; A63B 21/005–0059; A63B 21/225; A63B 2220/51; A63B 2220/54

See application file for complete search history.

(56) References Cited

U.S. PATENT DOCUMENTS

| | | | | |
|---|---|---|---|---|
| 6,569,063 | B2 * | 5/2003 | Chen | A63B 21/0051 482/57 |
| 10,639,512 | B2 * | 5/2020 | Huang | A63B 21/015 |
| 2016/0153852 | A1 * | 6/2016 | Wu | A63B 21/00069 73/862.332 |
| 2017/0312581 | A1 * | 11/2017 | Chang | A63B 22/0605 |
| 2019/0217144 | A1 * | 7/2019 | Petrillo | A63B 22/0605 |
| 2021/0154517 | A1 * | 5/2021 | Petrillo | A63B 21/0051 |

* cited by examiner

*Primary Examiner* — Jennifer Robertson

(57) ABSTRACT

A torque detection device of fitness equipment, the fitness equipment contains: a frame, a flywheel rotatably connected on the frame, and the torque detection device. The torque detection device includes a loading sensor and a magnetoresistance mechanism. A magnet holder of the magnetoresistance mechanism is rotatably connected on a fixer by way of a rotary shaft and has multiple magnets. A steel cable is configured to actuate a magnet holder to rotate along the rotary shaft so as to change a position of a respective one magnet of multiple magnets relative to a flywheel, and an area of the respective one magnet which covers the flywheel is changeable, thus changing a magnetoresistance of the respective one magnet of the magnet holder when the flywheel rotates. The loading sensor is configured to detect a reaction force of a magnetoresistance mechanism so as to calculate a torque value of the flywheel.

7 Claims, 6 Drawing Sheets

TORQUE DETECTION DEVICE OF FITNESS EQUIPMENT

FIELD OF THE INVENTION

The present invention relates to a torque detection device of fitness equipment, and more particularly to a steel cable which is configured to actuate a magnet holder to rotate so that an area of the respective one magnet of multiple magnets which covers the flywheel is changed, thus changing a magnetoresistance of the respective one magnet of the magnet holder when the flywheel rotates, and a loading sensor is configured to detect a reaction force of a magnetoresistance mechanism so as to calculate a torque value of the flywheel.

BACKGROUND OF THE INVENTION

Conventional indoor sport equipment is applied to train muscles of different portions of a human body, thus exercising in a house indoors. The conventional indoor sport equipment contains treadmills, training ladders, rowing machines, and exercise bikes. Furthermore, a flywheel is fixed on fitness equipment, and a torque detection device is configured to exert resistance on the flywheel so that a user adjusts a torque value based on using requirements. However, the torque detection device is adjustable by manually contacting, thus causing abrasion or inaccurate torque detection after a period of using time.

The present invention has arisen to mitigate and/or obviate the afore-described disadvantages.

SUMMARY OF THE INVENTION

The primary aspect of the present invention is to provide a torque detection device of fitness equipment in which a steel cable is configured to actuate a magnet holder to rotate so that an area of the respective one magnet of multiple magnets which covers the flywheel is changed, thus changing a magnetoresistance of the respective one magnet of the magnet holder when the flywheel rotates, and a loading sensor is configured to detect a reaction force of a magnetoresistance mechanism so as to calculate a torque value of the flywheel.

DETAILED DESCRIPTION OF THE PREFERRED EMBODIMENTS

Figure 1:
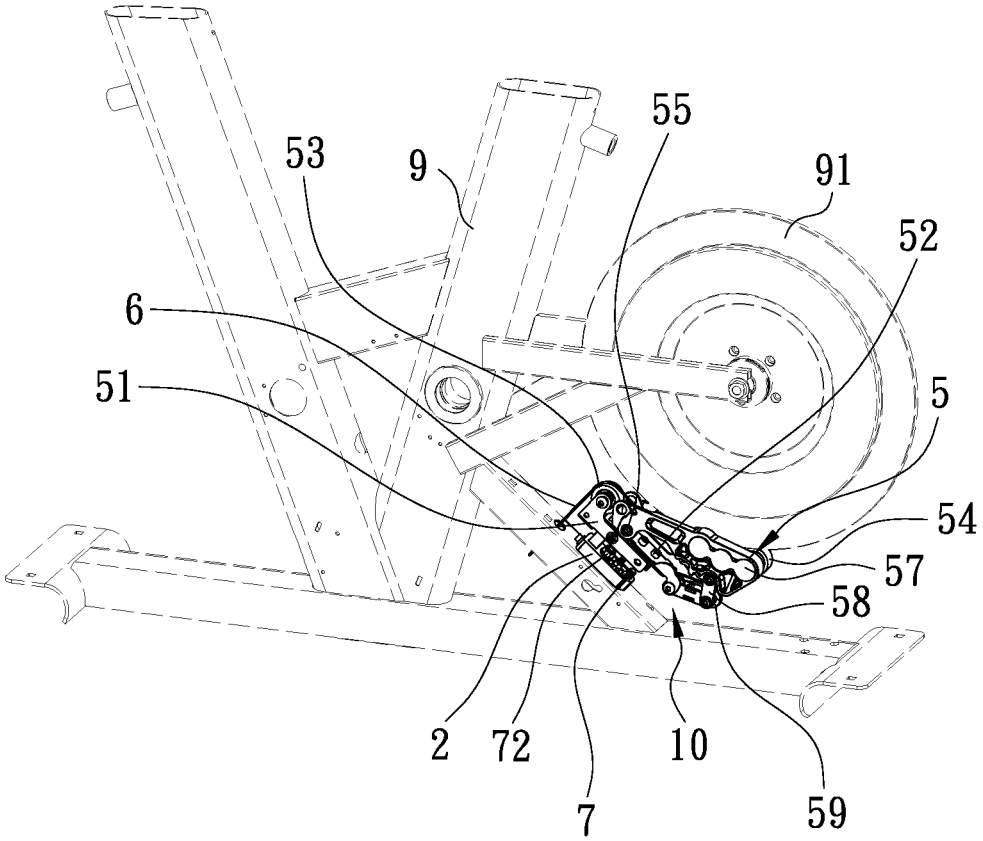
FIG. 1 is a perspective view showing the assembly of a torque detection device of fitness equipment according to a first embodiment of the present invention.

With reference to FIG. 1, a torque detection device 10 of fitness equipment according to a first embodiment of the present invention, wherein a steel cable 6 is configured to actuate a magnet holder 54 to rotate so that a position of a respective one magnet 57 of multiple magnets 57 relative to a flywheel 91 is changeable, for example, an area of the respective one magnet 57 which covers the flywheel 91 is changed, thus changing a magnetoresistance of the respective one magnet 57 of the magnet holder 54, when the flywheel 91 rotates. In addition, a loading sensor 1 is configured to detect a reaction force of a magnetoresistance mechanism 5 so as to calculate a torque value of the flywheel 91.

Figure 2:
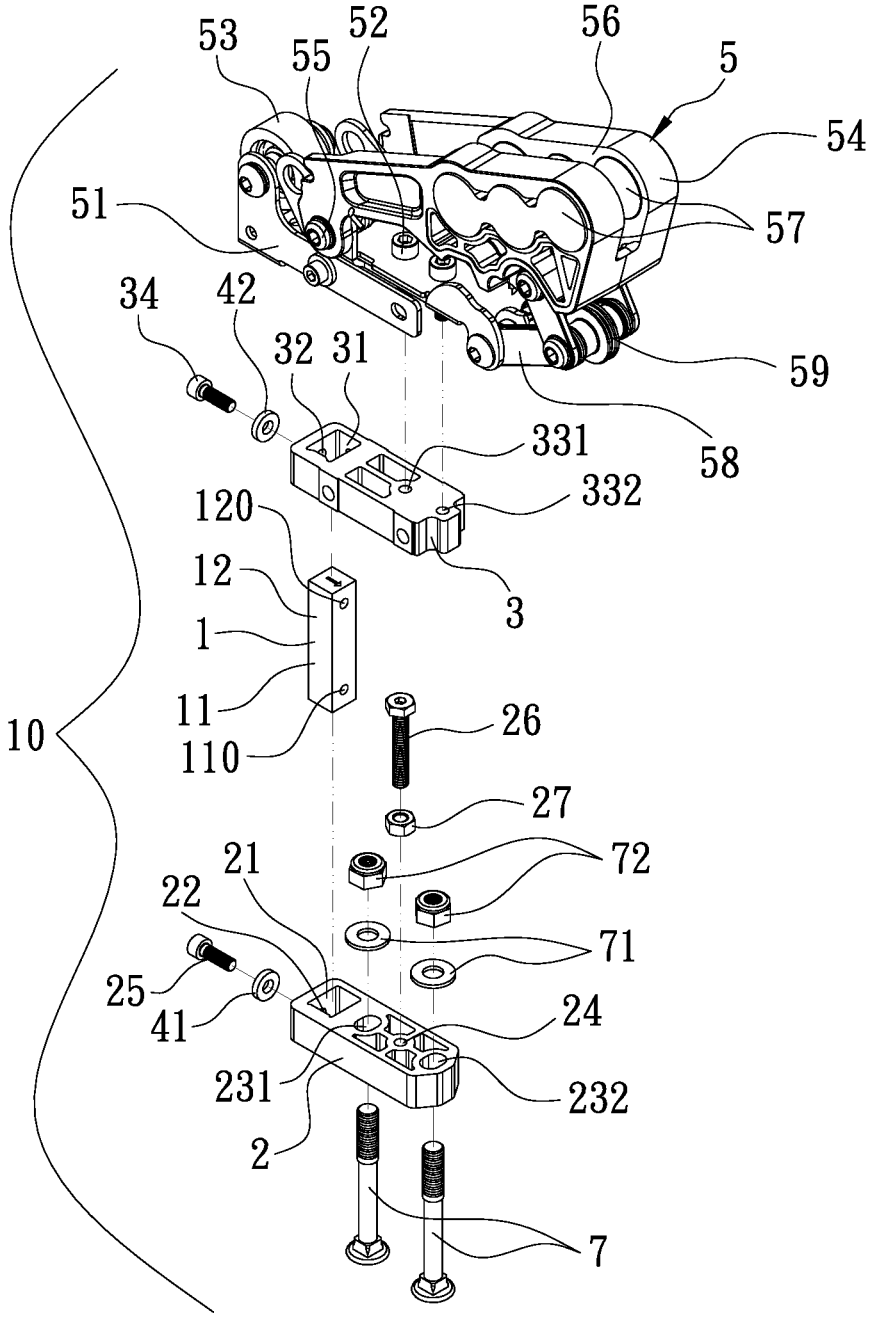
FIG. 2 is a perspective view showing the exploded components of the torque detection device of the fitness equipment according to the first embodiment of the present invention.
Figure 4:
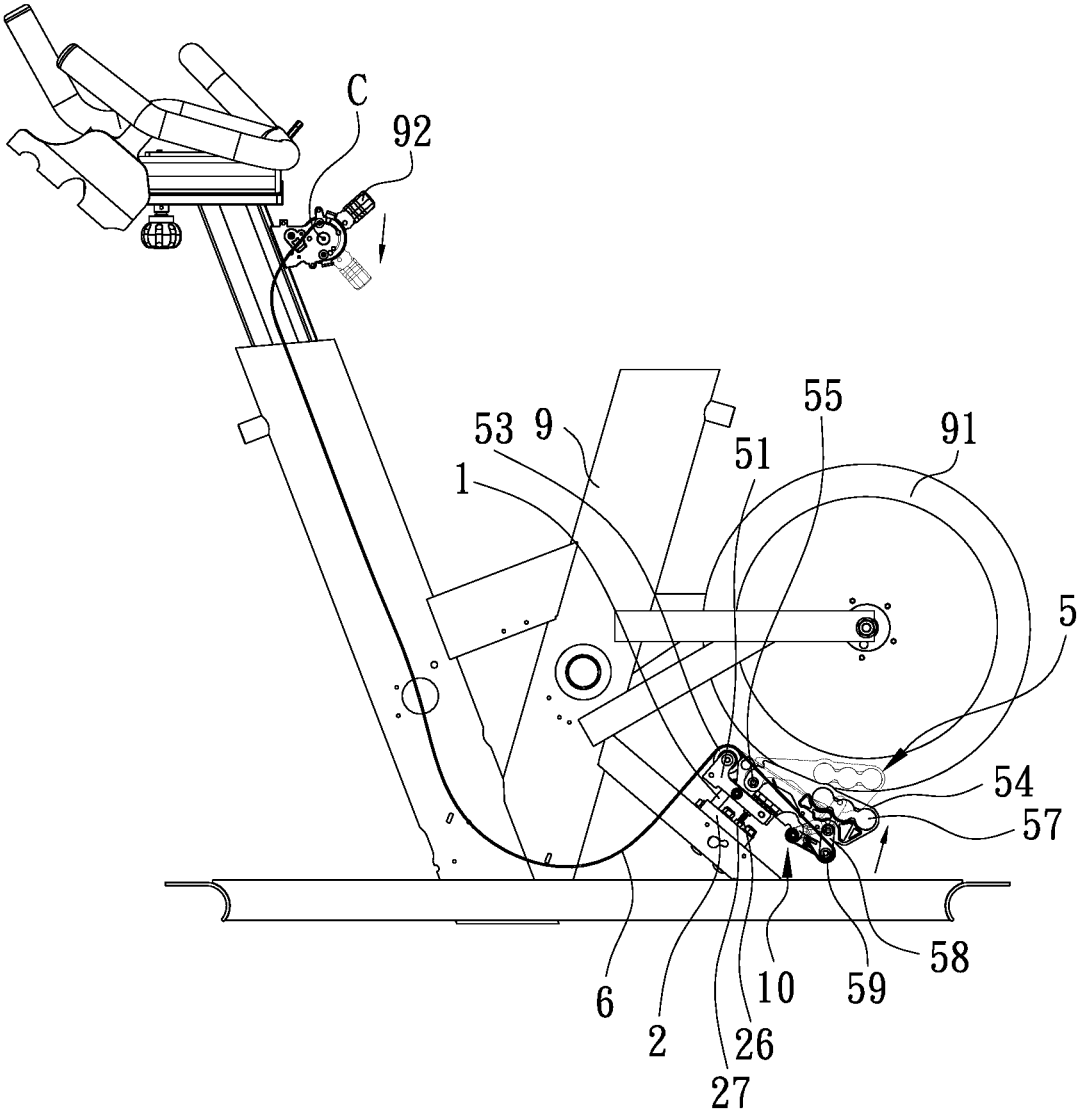
FIG. 4 is a side plan view showing the operation of the torque detection device of the fitness equipment according to the first embodiment of the present invention.

Referring to FIGS. 1 and 4, the fitness equipment comprises a frame 9, the flywheel 91 rotatably connected on the frame 9, the torque detection device 10, and As shown in FIG. 2, the torque detection device 10 includes the loading sensor 1 and the magnetoresistance mechanism 5, wherein the loading sensor 1 has a first segment 11 and a second segment 12, the first segment 11 of the loading sensor 1 has a first positioning orifice 110, and the second segment 12 of the loading sensor 1 has a second positioning orifice 120. The torque detection device 10 further includes a first connection seat 2 having a first fixing groove 21, a first through orifice 22 communicating with the first fixing groove 21, multiple passing orifices 231, 232, and a first threaded orifice 24 defined between the multiple passing orifices 231, 232. The first segment 11 of the loading sensor 1 is accommodated in the first fixing groove 21 of the first connection seat 2, and a first locating element 25 is inserted into the first through orifice 22 and is screwed with the first positioning orifice 110 of the loading sensor 1. Furthermore, a hexagonal bolt 26 is screwed on the threaded orifice 24 of the first connection seat 2 by mating with a nut 27. The torque detection device 10 further includes a second connection seat 3 having a second fixing groove 31, a second through orifice 32 communicating with the second fixing groove 31, and multiple second threaded orifice 331, 332. The second segment 12 of the loading sensor 1 is accommodated in the second fixing groove 31 of the second connection seat 3, and a second locating element 34 is inserted into the second through orifice 32 and is screwed with the second positioning orifice 120 of the loading sensor 1. A first washer 41 is mounted between the first locating element 25 and the first connection seat 2, and a second washer 42 is fixed between the second locating element 34 and the second connection seat 3, thus increasing friction area and positioning effect. The magnetoresistance mechanism 5 includes a fixer 51, multiple third locating elements 52 configured to connect the second connection seat 3 on a bottom of the fixer 51, a roller 53 disposed on a first end of the fixer 51, the magnet holder 54 rotatably connected on the fixer 51 by way of a rotary shaft 55, an accommodation space 56 defined on the magnet holder 54, and the multiple magnets 57 arranged on two sides of the accommodation space 56, wherein a second end of the fixer 51 is connected with a first end of a pair of connecting rods 58, a second end of the pair of connection rods 58 is coupled to a bottom of the magnet holder 54, and a rotary post 59 is fixed between the pair of connection rods 58, wherein a four-connection-rod mechanism is formed by the fixer 51, the magnet holder 54, and the pair of connecting rods 58. The torque detection device further includes the steel cable 6, wherein a first end of the steel cable 6 is connected with the fixer 51, and a second end of the steel cable 6 is rolled through the rotary post 59 of the pair of connection rods 58 and the roller 53 of the fixer 51 to fix on the at least one adjustment bar 92, as shown in FIG. 4.

As illustrated in FIGS. 1 and 4, when connecting the torque detection device 10, multiple defining bolts 7 are inserted through the frame 9 and the multiple passing orifices 231, 232 of the first connection seat 2 to connect with multiple third washers 71 and multiple nuts 72, and a peripheral side of the flywheel 91 is received in the accommodation space 56 of the magnet holder 54, wherein the multiple magnets 57 produce magnetoresistance against the flywheel 91.

Figure 5:
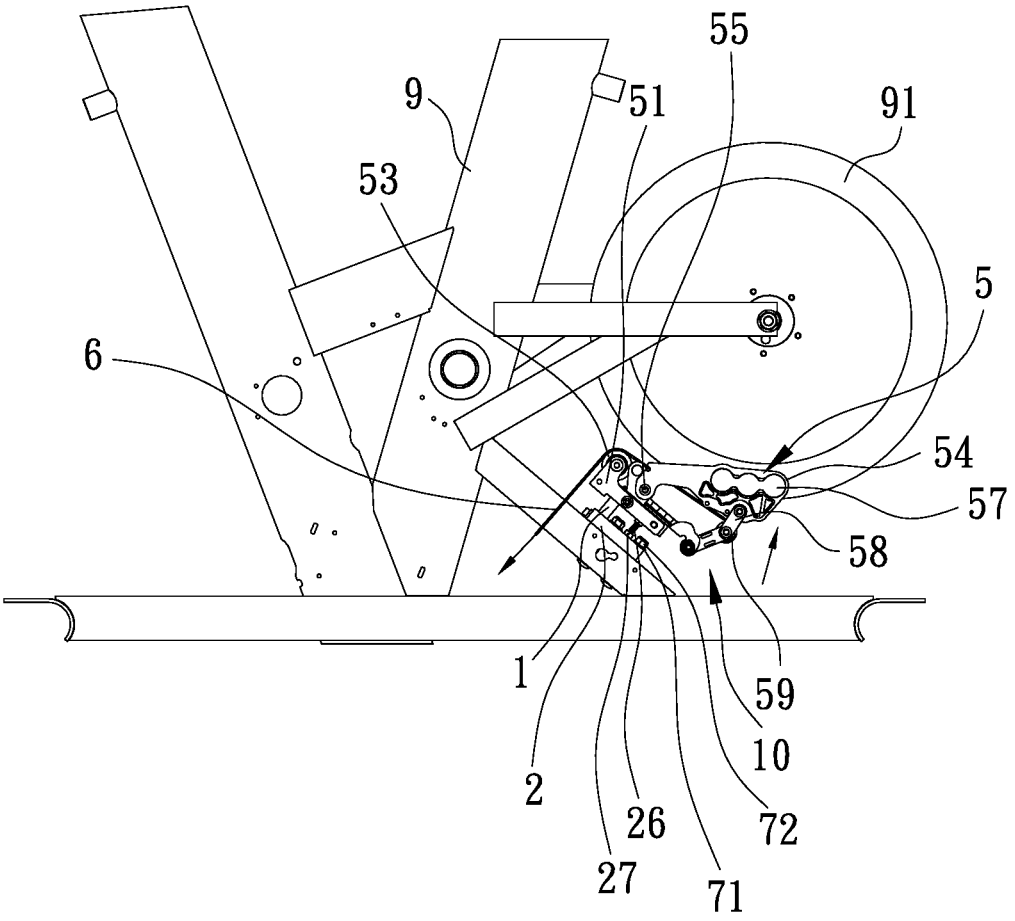
FIG. 5 is another side plan view showing the operation of the torque detection device of the fitness equipment according to the first embodiment of the present invention.
Figure 6:
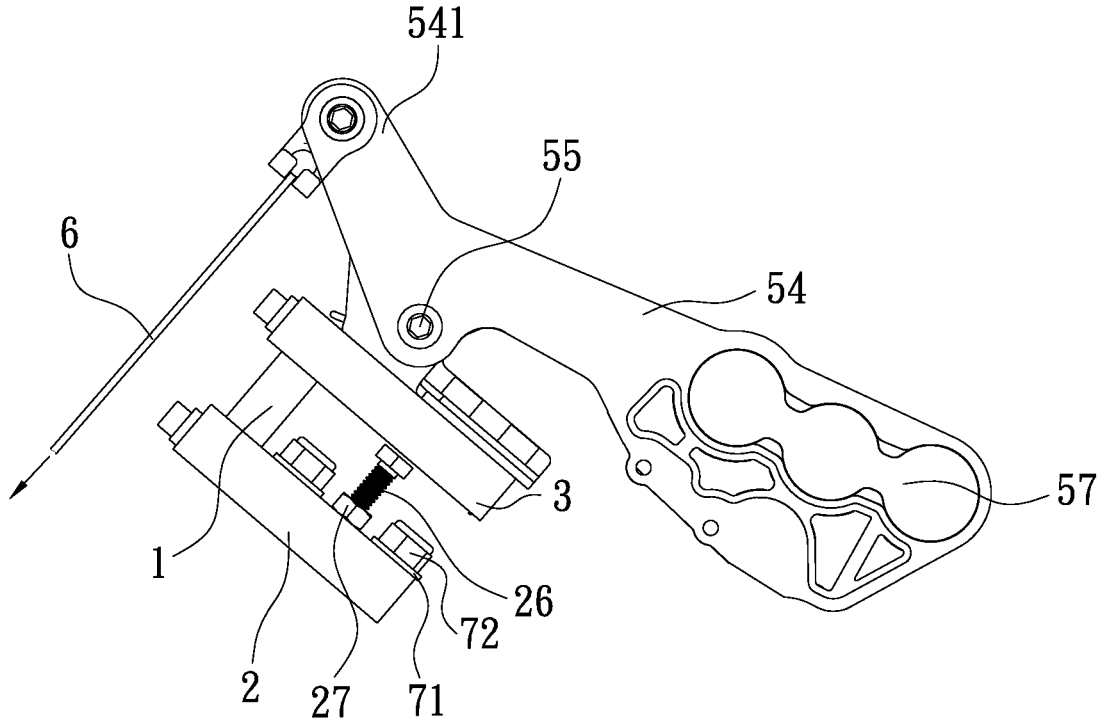
FIG. 6 is a side plan showing the operation of a torque detection device of fitness equipment according to a second embodiment of the present invention.

With reference to FIGS. 1 and 4, when the at least one adjustment bar 92 is forced by an external force to rotate along the central shaft C, the steel cable 6 is pulled by the at least one adjustment bar 92 to urge the rotary post 59 of the pair of connection rods 58 to rotate, and the magnet holder 54 rotates along the rotary shaft 55 and is pushed upward by the pair of connection rods 58, hence the position of the respective one magnet 57 relative to the flywheel 91 is changed (as shown in FIG. 5) to change the magnetoresistance of the respective one magnet 57 of the magnet holder 54, and the loading sensor 1 detects the reaction force of the magnetoresistance mechanism 5, thus calculating the torque value of the flywheel 91.

Figure 3:
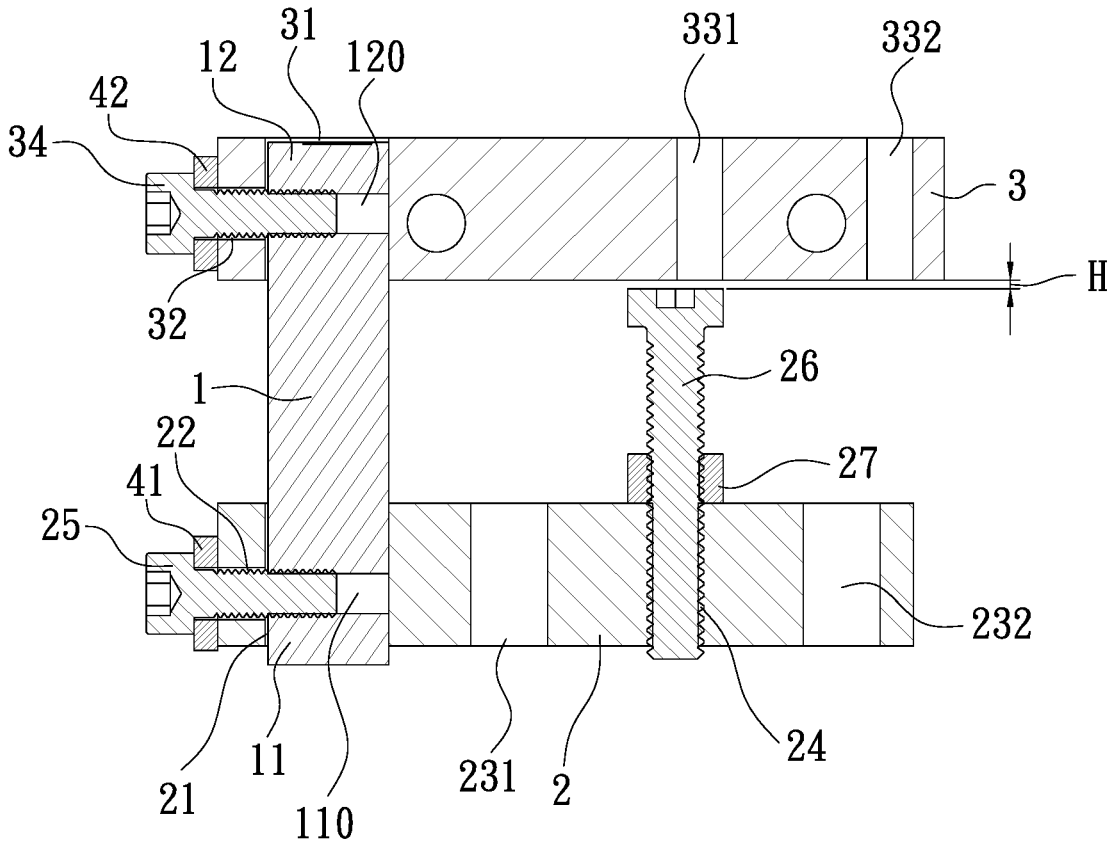
FIG. 3 is a cross sectional view showing the assembly of a part of the torque detection device of the fitness equipment according to the first embodiment of the present invention.

The first segment 11 of the loading sensor 1 is connected with the first connection seat 2, the second segment 12 of the loading sensor 1 is coupled with the second connection seat 3, and the hexagonal bolt 26 is defined between the first connection seat 2 and the second connection seat 3, wherein a gap is defined between a top of the hexagonal bolt 26 and the second connection seat 3, the hexagonal bolt 26 is configured to avoid deformation of the loading sensor 1 pressed by the fitness equipment, as shown in FIG. 3.

In a second embodiment, the magnet holder 54 has a tail extension 541, a first end of the steel cable 6 is rotatably connected on the tail extension 541 of the magnet holder 54, and a second end of the steel cable 6 is mounted on the at least one adjustment bar 92. Thereby, when the at least one adjustment bar 92 is pulled by the external force to rotate along the central shaft C, the steel cable 6 is synchronously pulled by the at least one adjustment bar 92 (as shown in FIG. 4) to urge the magnet holder 54 to revolve along the rotary shaft 55.

Accordingly, the magnet holder 54 of the torque device 10 of the fitness equipment is actuated by the steel cable 6 to change the position of the respective one magnet 57 of the magnet holder 54 relative to the flywheel 91, such as the change of the area of the respective one magnet 57 which covers the flywheel 91, thus changing the magnetoresistance of the respective one magnet 57 of the magnet holder 54. Preferably, the loading sensor 1 is configured to detect the reaction force of the magnetoresistance mechanism 5, and the torque value of the flywheel 91 is calculated.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. A torque detection device of fitness equipment, the fitness equipment comprising:

a frame, a first connection seat fixed on the frame, a flywheel rotatably connected on the frame, and the torque detection device;

the torque detection device including:

a loading sensor comprising a first segment and a second segment, and a magnetoresistance mechanism comprising a fixer and a magnet holder;

the second segment of the loading sensor being accommodated in a second connection seat, the second connection seat being connected to a bottom of the fixer of the magnetoresistance mechanism, the first segment being connected to the first connection seat;

a first end of the magnet holder of the magnetoresistance mechanism being rotatably connected on the fixer by way of a rotary shaft, and the magnet holder of the magnetoresistance mechanism comprising multiple magnets arranged on a second end of the magnet holder; and a steel cable configured to actuate the magnet holder to rotate around the rotary shaft so as to change a position of a respective one magnet of the multiple magnets relative to the flywheel, and an area of the respective one magnet which covers the flywheel being changeable, thus changing a magnetoresistance of the respective one magnet of the magnet holder when the flywheel rotates;

the loading sensor being configured to detect a reaction force of the magnetoresistance mechanism so as to calculate a torque value of the flywheel.

2. The torque detection device as claimed in claim 1, characterized in that an end of the fixer of the magnetoresistance mechanism is connected to a first end of a pair of connecting rods, a second end of the pair of connection rods being coupled to a bottom of the magnet holder, and a rotary post is coupled between the pair of connection rods.

3. The torque detection device as claimed in claim 1, characterized in that the first segment of the loading sensor has a first positioning orifice, and the second segment of the loading sensor has a second positioning orifice, the first connection seat has a first fixing groove, a first through orifice communicating with the first fixing groove, multiple passing orifices, and a first threaded orifice defined between the multiple passing orifices, wherein the first segment of the loading sensor is accommodated in the first fixing groove of the first connection seat, and a first locating element is inserted into the first through orifice and is screwed with the first positioning orifice of the loading sensor, wherein a bolt is screwed on the threaded orifice of the first connection seat by mating with a nut, and the second connection seat has a second fixing groove, a second through orifice communicating with the second fixing groove, and multiple second threaded orifices, wherein the second segment of the loading sensor is accommodated in the second fixing groove of the second connection seat, and a second locating element is inserted into the second through orifice and is screwed with the second positioning orifice of the loading sensor, wherein a first washer is mounted between the first locating element and the first connection seat, and a second washer is fixed between the second locating element and the second connection seat.

4. The torque detection device as claimed in claim 2, characterized in that the frame has at least one adjustment bar fixed thereon and rotatable along a central shaft; the magnetoresistance mechanism includes a roller disposed on an end of the fixer, an accommodation space defined on the magnet holder, and the multiple magnets are arranged on two sides of the accommodation space; wherein a first end of the steel cable is connected with the fixer of the magnetoresistance mechanism, and a second end of the steel cable extends through the rotary post of the pair of connection rods and the roller of the fixer to connect to the at least one adjustment bar.

5. The torque detection device as claimed in claim 4, characterized in that when connecting the torque detection device, multiple defining bolts are inserted through the frame and multiple passing orifices of the first connection seat to connect with multiple washers and multiple nuts, and a peripheral side of the flywheel is received in the accommodation space of the magnet holder, wherein the multiple magnets produce magnetoresistance against the flywheel.

6. The torque detection device as claimed in claim 1, characterized in that a bolt is disposed between the first connection seat and the second connection seat, a gap is defined between a top of the bolt and the second connection seat, and the bolt is configured to prevent deformation of the loading sensor when pressed by the fitness equipment.

7. The torque detection device as claimed in claim 2, characterized in that the frame has at least one adjustment bar fixed thereon and rotatable along a central shaft; wherein the magnet holder has a tail extension, a first end of the steel cable is connected to the tail extension of the magnet holder, and a second end of the steel cable is connected to the at least one adjustment bar, such that when the at least one adjustment bar is moved by an external force to rotate around the central shaft, the steel cable is pulled by the at least one adjustment bar to urge the magnet holder to rotate around the rotary shaft.

* * * * *